US005736714A

United States Patent [19]

Bechtold, Jr.

[11] Patent Number: 5,736,714

[45] Date of Patent: Apr. 7, 1998

[54] PORTABLE TOWEL HEATING APPLIANCE WITH ACCESSORIES

[76] Inventor: Joseph A. Bechtold, Jr., 3890 Salisbury Rd., South Euclid, Ohio 44121

[21] Appl. No.: 402,185

[22] Filed: Mar. 10, 1995

Related U.S. Application Data

[63] Continuation-in-part of Ser. No. 981,067, Nov. 24, 1992, Pat. No. 5,397,875.

[51] Int. Cl.[6] ..... H05B 3/00; B65D 69/00

[52] U.S. Cl. ..... 219/521; 219/386; 219/524; 206/581

[58] Field of Search ..... 219/521, 524, 219/525, 385, 386, 387, 401, 402, 432, 438; 206/581, 570, 438; 68/21.22 A, 241; 128/204.17, 206.21, 203.17, 203.16

[56] References Cited

U.S. PATENT DOCUMENTS

| | | | |
|---|---|---|---|
| 154,418 | 8/1874 | Reed et al. | 222/146.5 |
| 1,418,142 | 5/1922 | Fenaes et al. | 222/146.5 |
| 1,464,255 | 8/1923 | Zimmermann | 219/432 |
| 1,715,913 | 6/1929 | Halk | 206/581 |
| 1,804,752 | 5/1931 | Dooley | 68/5 |
| 1,979,222 | 10/1934 | Goodwin | 219/44 |
| 2,209,430 | 7/1940 | Turshin | 219/38 |
| 2,215,688 | 9/1940 | Chamberlain | 219/38 |
| 2,228,934 | 1/1941 | Tjomsland | 128/36 |
| 2,230,238 | 2/1941 | Duberstein et al. | 219/40 |
| 2,324,337 | 7/1943 | Jomsland | 128/65 |
| 2,340,932 | 2/1944 | Chalupa | 219/19 |
| 2,352,951 | 7/1944 | Geria | 126/263 |
| 2,443,321 | 6/1948 | Miner, Jr. | 68/5 |
| 2,825,208 | 3/1958 | Anderson | 62/81 |
| 3,074,394 | 1/1963 | Witt | 126/261 |
| 3,190,502 | 6/1965 | Knibb | 222/146 |
| 3,307,687 | 3/1967 | Steinman | 206/47 |
| 3,351,737 | 11/1967 | Katzman et al. | 392/391 |
| 3,495,343 | 2/1970 | Duncanson | 128/203.27 |
| 3,591,768 | 7/1971 | Torres | 219/387 |
| 3,678,248 | 7/1972 | Tricault et al. | 219/525 |
| 3,732,955 | 5/1973 | Carter et al. | 190/51 |
| 3,746,837 | 7/1973 | Frey et al. | 219/387 |
| 3,814,900 | 6/1974 | Frey et al. | 219/385 |
| 3,869,595 | 3/1975 | Collins et al. | 219/387 |
| 3,894,537 | 7/1975 | Camp | 128/204.17 |
| 3,902,044 | 8/1975 | Doyle et al. | 219/284 |
| 3,914,988 | 10/1975 | Avoy | 68/241 |
| 3,974,358 | 8/1976 | Goltsos | 219/387 |
| 3,978,238 | 8/1976 | Frey et al. | 426/523 |
| 4,084,080 | 4/1978 | McMahan | 219/401 |
| 4,163,896 | 8/1979 | McAvinn et al. | 219/525 |

(List continued on next page.)

*Primary Examiner*—Teresa J. Walberg
*Assistant Examiner*—Sam Piak
*Attorney, Agent, or Firm*—David A. Burge

[57] ABSTRACT

A portable appliance for heating towels and for dispensing heated fluid such as body oil has a suitcase-like housing with hinge-connected base and lid components that define a plurality of compartments for heating towels and liquid when the housing is "open" and the appliance is "set up" for operation, and for receiving components and accessories of the appliance so that the appliance can be conveniently stored and transported when the housing is "closed." A relatively large main compartment is defined by the housing for receiving and suitably heating towels therein for use in concert with the administration of a massage. "Wet" or "dry" towel heating can be carried out within the main heating compartment. A "wringer" for extracting unwanted moisture from towels is defined by a housing portion that drains into the main compartment, and by a towel compressor member that is pivotally connected to the housing. One accessory is a dispensing container for heated liquid, which fits into a special heating element equipped well of the housing, with the container being configured to closely receive the heating element to ensure rapid heating of the contents of the container. Another accessory is a mask that can be connected to the appliance to duct moist, heated air from a steam well of the main compartment to the vicinity of one's face for breathing to relieve cold symptoms.

28 Claims, 9 Drawing Sheets

U.S. PATENT DOCUMENTS

| | | | |
|---|---|---|---|
| 4,350,274 | 9/1982 | Morgan | 224/205 |
| 4,419,568 | 12/1983 | Van Overloop | 219/441 |
| 4,523,078 | 6/1985 | Lehmann | 219/202 |
| 4,836,368 | 6/1989 | Cotton | 206/205 |
| 4,857,708 | 8/1989 | DeMars | 219/385 |
| 4,918,290 | 4/1990 | DeMars | 219/400 |
| 4,947,026 | 8/1990 | Groom et al. | 219/401 |
| 5,012,542 | 5/1991 | Lynn | 68/241 |
| 5,183,994 | 2/1993 | Bowles, Sr. et al. | 219/387 |
| 5,208,896 | 5/1993 | Katayev | 392/444 |
| 5,296,681 | 3/1994 | Tschauder | 219/410 |

PORTABLE TOWEL HEATING APPLIANCE WITH ACCESSORIES

CROSS-REFERENCE TO RELATED APPLICATION

The present application is a continuation-in-part of application Ser. No. 07/981,067 filed Nov. 24, 1992 by Joseph A. Bechtold entitled PORTABLE APPLIANCE FOR HEATING TOWELS AND FOR DISPENSING HEATED FLUID SUCH AS BODY OIL TO FACILITATE THE ADMINISTRATION OF A MASSAGE, issued Mar. 14, 1995 as U.S. Pat. No. 5,397,875, referred to hereinafter as the "Parent Case," the disclosure of which is incorporated herein by reference. The invention that is the subject of the Parent Case will be referred to hereinafter as the "Parent Invention."

BACKGROUND OF THE INVENTION

1. Field of the Invention

The present invention relates generally to a portable towel heating appliance for use in concert with the administration of a massage. More particularly, the present invention relates to a portable, electrical, towel heating appliance having a suitcase-like housing that defines a relatively large main compartment wherein towels are heated "dry" or "wet," with a portion of the housing adjacent the main compartment cooperating with a member that is movably connected to the housing to provide a "built-in" wringer for compressively extracting and returning to the main compartment unwanted moisture from heated towels. Other features reside in the provision, as accessories, a dispensing container that can be heated by being inserted into a special heater-equipped well of the housing, and a mask that can be connected to the appliance to duct moist, heated air from a steam well of the main compartment to the vicinity of one's face to be breathed to aid in the relief of cold and flu symptoms, or the like.

2. Prior Art

It is known to use heated towels together with heated fluid such as body oil in concert with the administration of a massage. Prior to the introduction of the "Parent Invention" that is the subject of the "Parent Case" referenced above, most proposals for apparatus to heat towels included no means for heating fluids; and, most proposals for apparatus to heat fluids included no means for heating towels.

While a variety of electrical towel heating devices had been proposed prior to the introduction of the Parent Invention, few of the previously proposed devices were intended to be transported from place to place and stored with the convenience of a suitcase. Some of these prior proposals were intended to "dry heat" towels, for example to drive out moisture after towels had been used by one who had taken a bath or shower. Some of these prior proposals were intended to "wet heat" towels, for example to provide hot moist towels to be used by therapists in deep heating sore muscles of athletes. Still other prior proposals were said to be adaptable to effect either "dry" or "wet" heating. Most of these proposals, however, related to relatively complex units that were intended for salon, barber shop or training room use, not for consumer use in a typical home environment.

While a variety of electrical fluid heating devices had been proposed prior to the introduction of the Parent Invention, many were intended for use in heating and/or maintaining the elevated temperature of such consumable beverages as coffee, tea or hot chocolate. Such devices were not found to be well suited for use in heating towels and fluid such as body oil that are used in concert with the administration of a massage. Nor did previous fluid heater proposals typically provide portable units that were transportable with the ease of a suitcase, or that were intended not only to heat but also to facilitate transport and storage of the various components of the appliance and its accessories.

Thus, while the benefits of massage in relieving muscle aches and pains, and in relieving "stress," "tension" and the like have long been known, prior to the introduction of the Parent Invention, a need had long existed for an easy-to-transport, easy-to-store, highly versatile kit-like unit that can be used at bedside or elsewhere in the home to assist in providing properly heated towels, properly heated body oil and the like to facilitate the administration of a massage.

3. The Parent Invention and the Parent Case

As is pointed out in the Parent Case, the Parent Invention addresses the foregoing and other needs and drawbacks and of the prior art by providing a novel and improved portable appliance for heating towels and fluids such as body oil that commonly are used in concert with the administration of a massage.

One feature of the preferred practice of the Parent Invention resides in its provision of a suitcase-like housing having hinge-connected base and lid components that are utilized to define a plurality of appropriately configured compartments 1) to permit a supply of spare towels to be kept readily at hand while other towels are being heated selectively in a "dry" or "wet" manner; 2) to permit a dispensing container of fluid such as body oil to also be heated to and maintained at a desired temperature at the same time that towels are being heated; and, 3) to cooperatively receive and enclose not only the various component parts of the unit but also a supply of towels and dispensable fluid such as body oil when the unit is not being used, whereby not only the appliance but also such supplies as typically are used with the appliance can be stored and transported from place to place as a "kit," but with the ease and convenience of a suitcase.

Other features of the preferred practice of the Parent Invention cooperate synergistically to provide an appliance that, when "set up" (i.e., when assembled and readied to function), provides a well-balanced, height-adjustable unit that can be positioned almost anywhere that it is needed to facilitate the administration of a massage. Preferably included in this combination are such features as: 1) lid and base components of a hinged, suitcase-like housing that utilize slide-together hinge components which permit the lid to be easily disconnected from the base so that the base can be stand-supported without being rendered unduly top-heavy or being thrown out-of-balance by the weight of the lid; 2) electrical components and associated circuitry that, with the exception of a power cord that is extensible from within a compartment of the base, are confined to and housed within the base whereby the base of the unit provides all of the electrical heating functions of the unit; and, 3) the provision of an elongate compartment within the lid, from which support means such as an adjustable set of legs can be removed and connected to the base for supporting the base at desired heights above a support surface such as a floor. The advantageous arrangement that results from the afore-described combination of features permits the lid of the appliance to be set aside while the appliance is being used, whereby the appliance can be positioned, for example, at a bedside so that properly heated towels and properly heated body oil readily are made available to facilitate the administration of a massage for purposes of warming and relaxing aching back muscles of a person who is resting on the bed.

SUMMARY OF THE INVENTION

The present invention builds and improves upon such appliance features as are disclosed in the Parent Case, by addressing needs and preferences that have come to light in a continuing program of testing and development that initially gave rise to the Parent Invention. Whereas the Parent Invention relates to a novel and useful new appliance, the present invention relates to appliance improvements and enhancements.

While there are differences, the preferred practice of the present invention shares much in common with the preferred practice of the referenced Parent Invention. A portable appliance is provided for heating towels and for dispensing heated fluid such as body oil. The appliance has a suitcase-like housing with hinge-connected base and lid components that define a plurality of compartments. The compartments that are defined by the housing serve 1) to heat towels and fluid when the appliance is "set up" for operation, and 2) to receive components and accessories of the appliance so that the housing of the appliance can be closed with such components, accessories and a set of supplies being housed therein—to enable the resulting "kit" to be conveniently stored and transported. When the housing is open, an optional support structure such as a set of legs can be removed from the housing for use in supporting at least the base portion of the housing at an a convenient access height above a floor or other substantially horizontal surface. A relatively large main compartment is defined by the housing for receiving and suitably heating towels therein for use in concert with the administration of a massage. "Wet" or "dry" towel heating can be carried out within the main heating compartment.

One way in which the preferred practice of the present invention differs from the preferred practice of the Parent Invention has to do with the provision of an improved form of towel wringer. The preferred practice of the Parent Invention utilized a somewhat complex, optional accessory type of towel wringer that could be carried within the main compartment of the appliance during transport. During testing, it has been found that the need to have a towel wringer at hand when the appliance is used is of sufficient import that a towel wringer probably should be provided as an integral component of the appliance itself, not as an accessory that inadvertently may be set aside and left behind when the appliance is transported from place to place. Moreover, it has been determined that a wringer of simpler, easier-to-use and less costly form should be provided.

The preferred practice of the present invention not only provides a housing-connected towel wringer, but also provides a much simpler, easier-to-use and less costly form of towel wringer that takes a of novel form that utilizes a specially configured portion of the housing of the appliance together with a single movable compressor plate to permit moisture laden towels to be squeezed one at a time therebetween. The compressor plate preferably is hingedly connectable to the housing so that excess moisture can be wrung from a towel by pivoting the compressor plate toward the specially configured housing portion with the towel being squeezed therebetween. Excess moisture wrung from a towel is ducted back into the main chamber to be reheated for reuse.

Another way in which the preferred practice of the present invention differs from the preferred practice of the Parent Invention has to do with the manner in which a fluid container and an appliance-energized heating element cooperate to rapidly heat a quantity of fluid such as body oil that typically is utilized in the administration of a massage. While the Parent Case discloses a fluid container that has a heating element included in the container itself, with the container being plug-and-socket connectable to the electrical system of the appliance to effect fluid heating, it has been found that the need to have a plurality of heated fluid containers at hand during the administration of a massage suggests that a less costly type of container that can be heated by an appliance-carried heating element (thereby requiring no container-carried heating element and no need to make electrical connection between the appliance and a container to heat fluid carried in the container) probably is desirable.

To address this need, the present invention provides an improved and less expensive form of fluid container featuring a novel configuration that permits a plurality of fluid containers to be mated, one at a time, with a specially configured, appliance-carried heater element located in a container-receiving well of the housing for rapidly heating contents of the container. This improved arrangement renders it more practical for plurality of fluid-containing containers to be kept at hand that each contain a somewhat different body oil or the like, with selected ones of these containers being kept suitably warm during the administration of a massage by inserting them one-at-a time, in rotation, into one or more container heater wells of the appliance.

Still another way in which the preferred practice of the present invention differs from the preferred practice of the Parent invention is in the provision of a new accessory that can be used in cooperation with other portions of the appliance to provide moist, heated air for one to inhale to aid in the relief of such nasal or bronchial congestion as may be encountered during an experience of cold or flu. A mask-like accessory that is connectable to the appliance is provided for ducting moist, heated air from a steam well of the main compartment to the vicinity of one's face to be breathed to aid in the relief of cold and flu symptoms, or the like. The breathing mask enhancement nicely broadens the range of useful service capability that is offered by the appliance, and is an accessory that, together with other components and accessories of the appliance, can be carried in the main compartment of the appliance during storage and transport.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
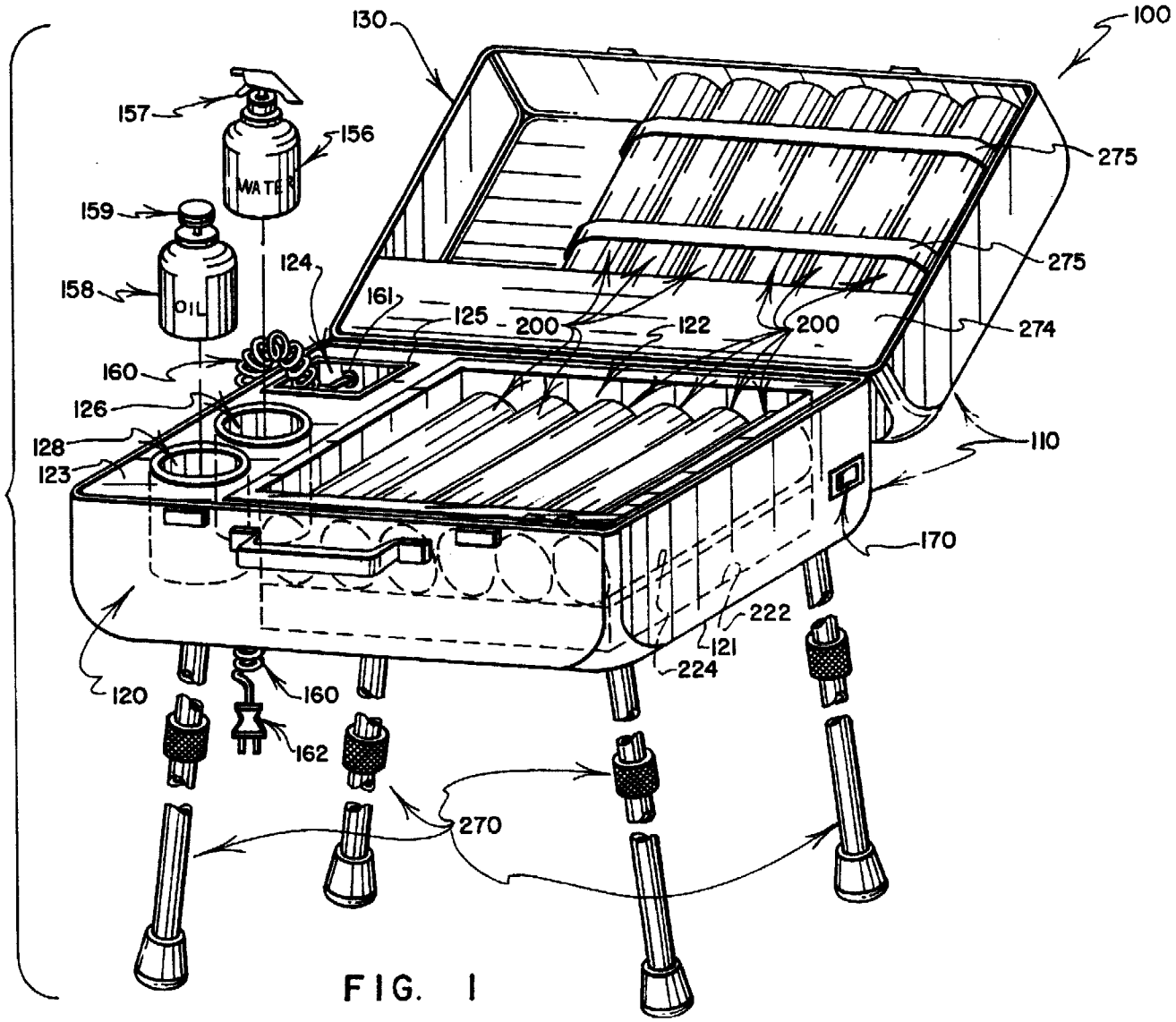
FIG. 1 is a exploded perspective view of a portable appliance that embodies the preferred practice of the Parent Invention (upon which the present invention builds and improves), with the suitcase-like housing of the appliance shown in an open position, with foreshortened leg-like supports shown removed from their storage position and connected to the base of the housing to support the housing in an elevated position, with an electrical power cord shown extending from its storage compartment to a position outside the housing, with rolled towels shown both in the lid and base of the housing, and with a pair of liquid containers that normally are carried in compartments in the base shown elevated above the base.
Figure 2:
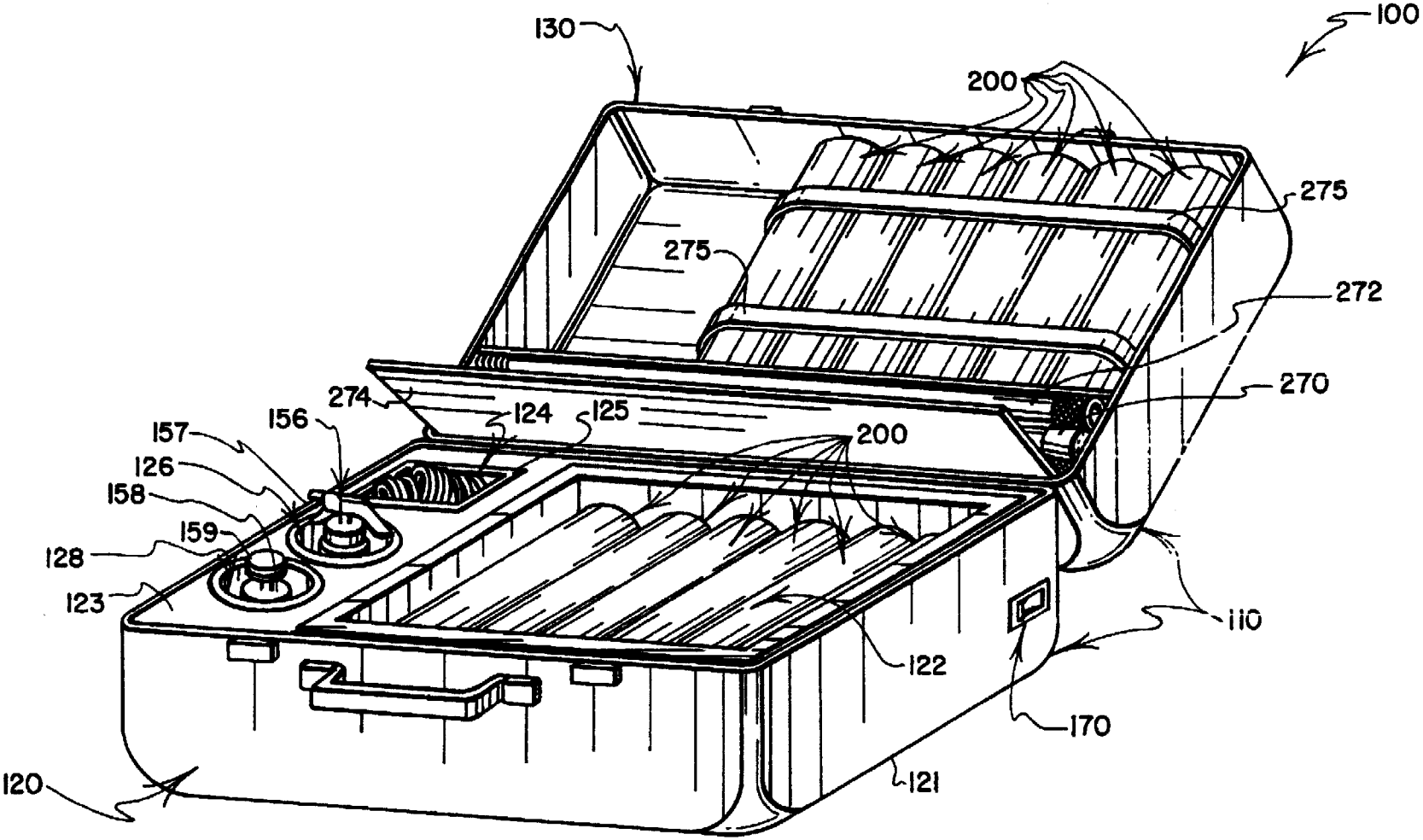
FIG. 2 is a perspective view of the appliance of FIG. 1, but with the leg-like supports stored in a compartment that is provided in the lid of the housing, with the power cord retracted to a position within a compartment that is provided for it in the base, and with the pair of liquid containers positioned in the compartments that they normally occupy within the base.

Referring to FIGS. 1 and 2, a portable electric appliance for heating towels and for dispensing heated fluid such as body oil to facilitate the administration of a massage is indicated generally by the numeral 100. The appliance 100 that is illustrated in FIGS. 1–8 of the drawings and that is described in first part of the description that follows represents the "best mode" and the "preferred practice" of the Parent Invention. Improvement features and enhancements made to the Parent Invention in accordance with the "best mode" and the "preferred practice" of the present invention are depicted in the drawings, beginning with FIG. 9.

It is appropriate to reproduce, here, a detailed description of features of the Parent Invention for the reason that the improvements and enhancements that form the subject matter of the present invention can best be understood by first gaining an understanding of the Parent Invention, which now will be described by referring to the features that are depicted in FIGS. 1–8.

Referring to FIGS. 1 and 2, the portable appliance 100 has an outer protective casing or housing that is indicated generally by the numeral 110. The casing or housing 110 includes a base 120 and a cover or lid 130 that are releasably, pivotally hinge-connected.

Figure 3:
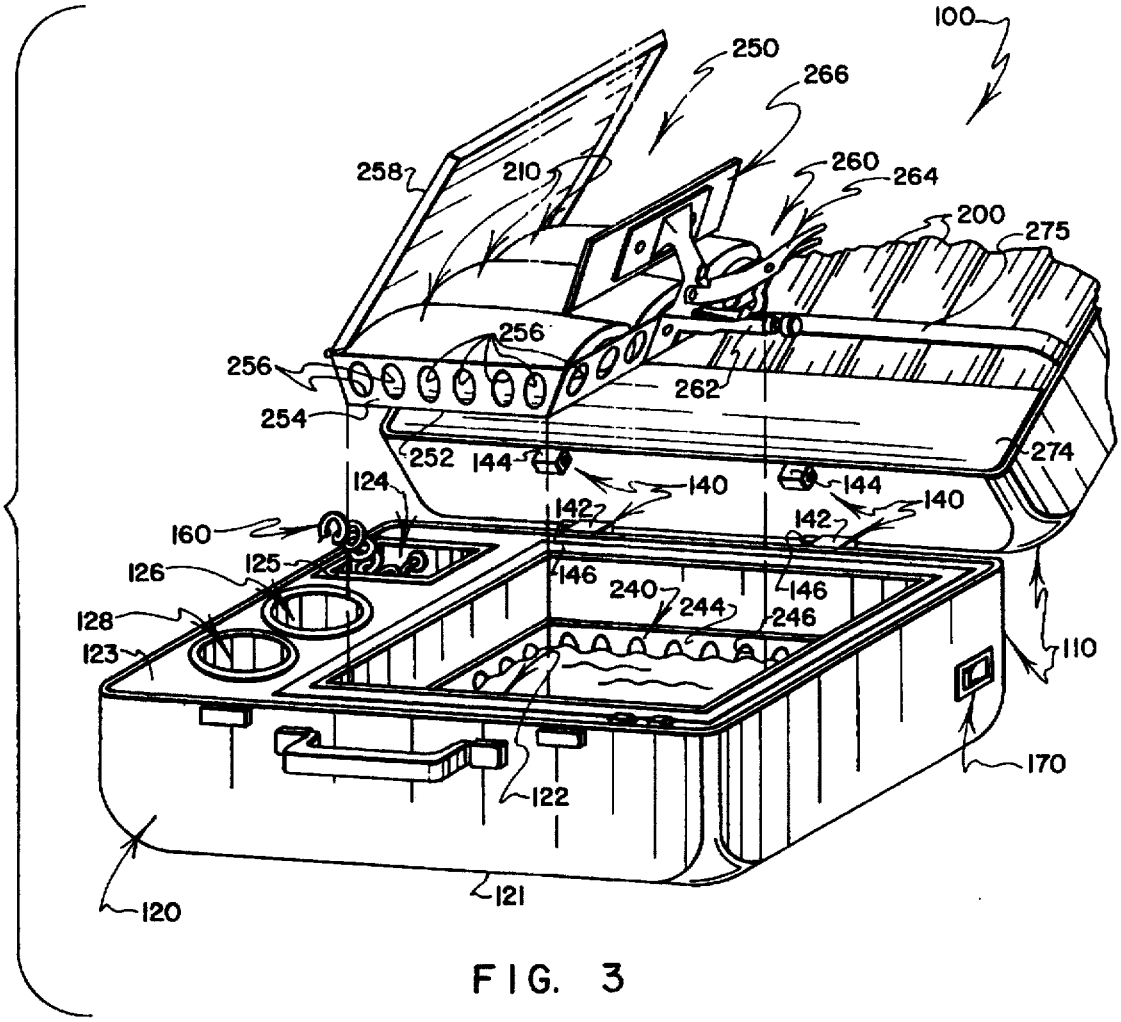
FIG. 3 is a perspective view of the appliance showing principally base portions thereof, but with the view also showing a disconnected portion of the lid of the housing, slide-together hinge components for releasably pivotally connecting the lid to the base of the housing, and an optional "wringer" device that can be inserted into the main heating compartment of the base of the appliance.

While hinge components that are carried by the base 120 and by the lid 130 are not shown in FIGS. 1 and 2, referring to FIG. 3, two sets of disconnected hinge components are indicated generally by the numeral 140. Each of the hinge sets 140 includes a base-carried hinge component 142 of generally "male" configuration, and a lid-carried hinge component 144 of generally "female" configuration. The hinge components 142, 144 of each of the sets 140 can be slided together to selectively connect the base 120 with the lid 130 for pivotal movement about a common axis (not shown) along which pin portions 146 of the base-carried components extend, or can be slided along the common axis (not shown) of the pin portions 146 to selectively disconnect the base 120 from the lid 130 so that the lid 130 can be separated from the base 120, as is depicted in FIG. 3.

Referring still to FIGS. 1 and 2, defined within the base 120 is a relatively large, generally rectangular, pan-like compartment 122 that will be referred to as defining the "main heating compartment, or," more main simply, as the "main compartment." Located to one side of the main heating compartment 122 is a power cord storage compartment 124, and a pair of compartments 126, 128 that are provided for receiving a pair of liquid dispensing containers 156, 158. In FIG. 1, the liquid dispensing containers 156, 158 are shown raised out of the compartments 126, 128. In FIG. 2, the liquid dispensing containers 156, 158 are shown nested within their associated compartments 126, 128.

In FIG. 1, portions of a coiled power cord 160 are shown extending out of the power cord storage compartment 124 and depending along and beneath left side portions of the base 120. A fuse-carrying two-prong electrical plug 162 is shown at one end of the power cord 160. To prevent a non-fuse-carrying power cord to be substituted for the fuse-carrying power cord 160, it will be understood by those who are skilled in the art that the other end region of the power cord 160 is permanently connected to the base 120, preferably using a commercially available water-tight grommet assembly 161 located within the power cord storage compartment 124 at a position that is relatively near a rim 125 of the power cord storage compartment 124.

To prevent moisture or the like from entering into the interior of the base 120 (i.e., into the space that extends between an outer cover 121 of the base 120 and an interior cover sheet 123 through which the various compartments 122, 124, 126, 128 open, or between the outer cover 121 and such structure as defines the compartments 122, 124, 126, 128), suitable moisture seals (not shown) are provided in a manner that is well known to those who are skilled in the art. Also, to prevent moisture or the like from entering into the interior of the base 120, each of the compartments 122, 124, 126, 128 is formed as a "sealed unit" that has a capability for receiving and retaining liquid without leakage. Thus, for example, if liquid is spilled inadvertently onto the cover sheet 123, the spilled liquid will not find its way into the interior of the base 120 where, as will be explained shortly, electrical heating components and associated circuitry are provided that electrically connect with the power cord 160.

Located along the right side of the outer cover 121 of the base 120 (as is depicted in FIGS. 1–3), is a manually operated power switch 170 that must be turned to an "on" position (not shown) to permit electrical power from the power cord 160 to be delivered to electrical heater components and other associated circuitry that are housed within the aforedescribed sealed interior of the base 120. By turning the power switch 170 to an "off" position (not shown), the delivery of electricity to electrical heater components and other associated circuitry that are housed within the interior of the base 120 is terminated.

While the power switch 170 is depicted as being located along the right side of the base 120, those who are skilled in the art will understand that the switch 170 may be positioned elsewhere on the base 120 so as to provide a conveniently located "off/on" switch. In preferred practice, the switch 170 is positioned at a location where the switch 170 is least likely to be splashed by water or other fluid as heated towels and heated fluid are provided in concert with the administration of a massage. However, to maximize safety, a water and weather resistant style of switch is selected to comprise the switch 170, many forms of which are commercially available.

Figure 6:
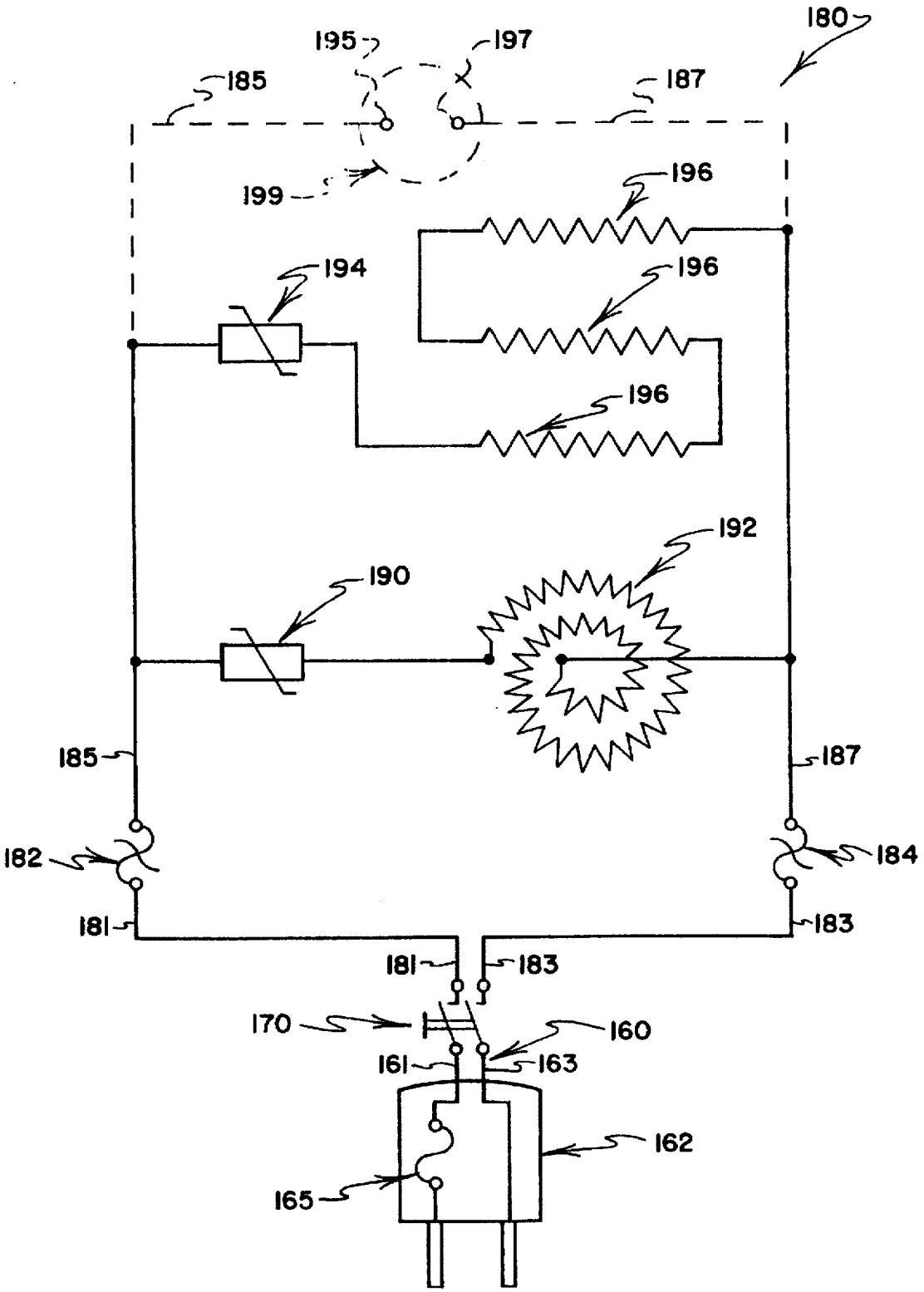
FIG. 6 is a schematic diagram illustrating a typical electrical control circuit of the type that can be used to operate electrical components of the appliance, with dotted lines schematically indicating a simple manner in which the circuit that is shown in solid lines can be optionally extended to include a female electrical connector.

Referring to FIG. 6, a schematic diagram is provided to illustrate the character of such electrical circuit components as typically are utilized by the appliance 100 as component parts of a circuit that is designated generally by the numeral 180. Beginning toward the bottom of FIG. 6, the power cord 160 is depicted as having two electrical conductors 161, 163 that connect with the fuse-carrying two-prong plug 162. Housed within the plug in a replaceable manner is a fuse 165 that is selected to "blow" if current flowing into the circuit 180 exceeds that which is found during tests to comprise the normal maximum level of current that is required by the appliance 100 for proper operation.

Continuing with a description of the components of the electrical circuit 180 that is depicted in FIG. 6, the "off/on" power switch 170 serves to selectively connect the conductor 161 with a conductor 181; and to simultaneously selectively connect the conductor 163 with a conductor 183. Thermal sensor/protector devices 182, 184 are interposed between the conductor 181 and a conductor 185; and between the conductor 183 and a conductor 187. The thermal sensor/protector devices 182, 184 may take any of a wide variety of commercially available forms that serve to electrically connect two conductors when no condition of "overheat" is sensed, and that serve to disconnect such conductors when a condition of "overheat" is sensed. The thermal sensor/protector devices 182,184 are positioned as desired within the interior of the base 120 to sense and respond to overheating of such structures as form the main heating compartment 122 and the auxiliary compartment 128 wherein the container 158 preferably also is heated by components of the circuit 180. Upon sensing a condition of "overheat," either of the thermal sensor/protector devices 182, 184 can cut off the flow of power to the appliance 100 by terminating the electrically connection that normally is provided between its associated conductors 181, 185 and/or 183,187, respectively.

The conductors 185, 187 are utilized to provide electrical power to one or more thermostatically controlled heating devices. By way of one example, a commercially available thermostat control switch 190 is connected in series with a circularly disposed, resistance-type electrical heating element 192 that preferably is positioned to extend beneath and about the side walls of the auxiliary heating compartment 128 within which a container 158 of body oil or the like normally is positioned so as to be heated at the same time that towels are being heated within the main heating chamber 122. The thermostat 190 is selected to maintain an appropriate heating temperature for warming the container 158 and its contents so that body oil or other contents of the container 158 can be provided at an appropriately heated temperature.

If desired, a thermostat and coiled resistance-type electrical heating element (not shown) that are similar to the thermostat 190 and the heating element 192 also may be provided to heat the container 156 that is carried within the compartment 126; however, inasmuch as a supply of water typically is provided by the container 156, and inasmuch as the water supplied by the container 156 is not always desired to be of "heated" character, the circuit 180 often does not include a thermostat or a separate heating element for serving the compartment 126.

To heat the main heating chamber 122, a commercially available thermostat control switch 194 is connected in series with a series array of resistance-type electrical heating elements 196 that preferably are positioned to extend beneath and about the side walls of the main heating chamber 122. The thermostat 194 is selected to maintain an appropriate heating temperature for warming the structure of the chamber 122 so that towels that are positioned within the main heating chamber 122 may be suitably "wet" or "dry" heated. The series arrangement of the thermostat 194 and the heating elements 196 preferably is connected in parallel with the series arrangement of the thermostat 190 and the heating element 192 between the electrical conductors 185, 187 to receive electrical power therefrom.

Figure 7:
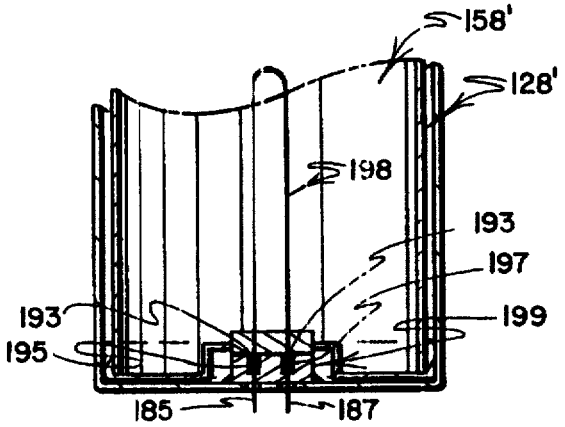
FIG. 7 is a sectional view showing bottom portions of an optional form heater-carrying liquid container and of a base compartment portion that receives the bottom portions of the container, with the container carrying a depending male electrical connector that is engaged with a female electrical connector that is carried by the bottom portions of the container so as to establish electrical connection between the engaged male and female connectors.
Figure 8:
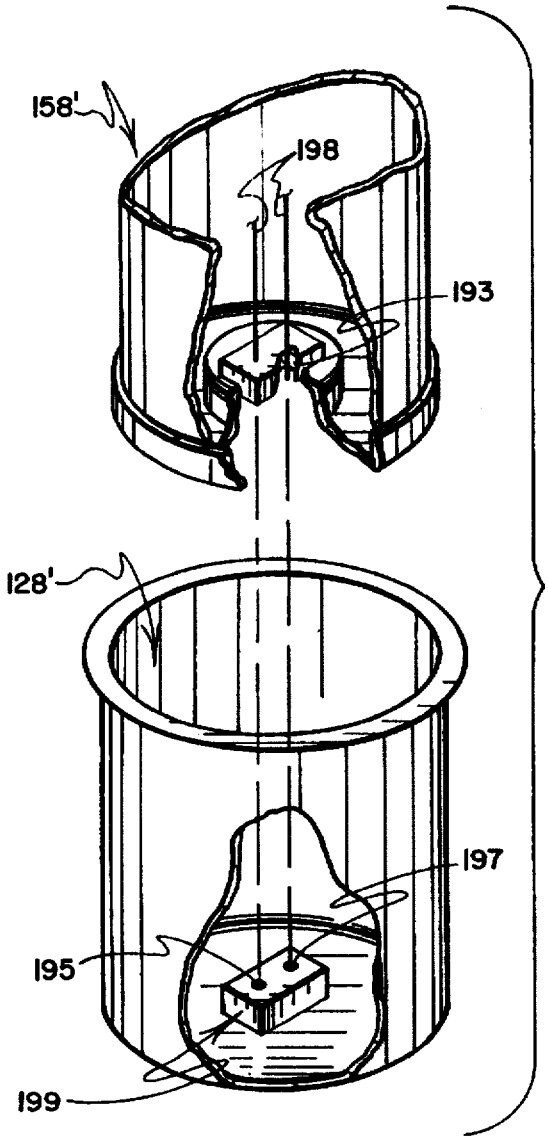
FIG. 8 is an exploded perspective view on an enlarged scale of the optional container and base portions of FIG. 7, with portions broken away to permit otherwise hidden features and detail to be seen, and with the female and male electrical connectors disengaged.

Shown in dotted lines toward the top of FIG. 6 are extensions of the conductors 185, 187 that connect with corresponding female connector contacts 195, 197, respectively, of an electrical plug 199. Referring to FIGS. 7 and 8, the use of the electrical plug 199 and mating-connector-carrying container that houses its own heating element 198 represent a less preferred manner in which an alternate form of fluid container such as the body oil container 158' can be heated while being positioned within an alternate form of the compartment 128'.

Actually, the structure of the compartment 128' is identical to that of the compartment 128 except that the compartment 127' has the connector 199 rigidly connected to an interior surface portion of its bottom wall. The plug 199 carries the female contacts 195, 197 that mate with the male contacts 193 of the heating element 198 when the container 158' is properly seated within the compartment 128'. In essence, the in-container heater element 198 resembles that which is used in many known types of coffee containers that "plug in" when positioned in engagement with a power-supplying appliance (not shown).

One reason why one might elect the described "alternate approach" is that the direct heating of a body of contained liquid (as by energizing a heating element 198 that extends directly into the body of liquid) often requires substantially less energy to effect the same result as is needed to indirectly heat the contained body of liquid by first heating its surrounding container.

Another reason why one might elect to use the aforedescribed alternate approach is that it can be used in concert with use of the resistance heater element 192 so that rapid heating of the body of fluid within the container 158' can be effected both by applying heat energy directly to the liquid by means of the container-carried heating element 198, and also by heating exterior surface portions of the container 158' by using the heating element 192. In preferred practice, however, only a single type of heating approach is utilized to warm liquid that is contained within a container 158 or 158'.

While the discussion that is provided herein tends to concentrate on the use of electrical resistance heating elements as a source for providing heat energy for heating towels and fluid such as body oil or the like, those who are skilled in the art readily will understand that other known and future forms of sources of heat energy (typically having their origin with a supply of electrical current, although other efficient and appropriately safe origins of heat energy are known and undoubtedly will be more commonly used with portable appliances during years to come) may be substituted and used herein without extending beyond the spirit and scope of the accompanying claims.

The liquid containers 156, 158, 158' preferably are provided with top openings (not shown) through which liquid to be dispensed is inserted into the interiors of the containers 156, 158, 158', and into which any desired form of commercially available cap-carried liquid dispenser (such as the cap-carried dispensers 157, 159 shown in FIGS. 1 and 2) are inserted to enable liquid to be easily manually dispensed from the containers 156, 158, 158'.

The main heating compartment 122 has lower and upper portions that are depicted by in phantom in FIG. 1 by a pair of rectangular box-like forms, with the lower portion being designated generally by the numeral 222, and with the upper portion being designated generally by the numeral 224. In the so-called "dry" heating of towels, a side-by-side array of relatively tightly rolled towels 200 preferably are supported to extend through the upper portion 224 of the main heating compartment 122 (in the manner that is depicted in FIGS. 1 and 2) so that the relatively tightly rolled towels 200 can be warmed by rising moist air and steam from the lower portion 222 of the main heating compartment 122. In the so-called "wet" heating of towels, a small number of relatively loosely rolled towels 210 preferably are positioned side-by-side within the lower portion 222 of the main heating compartment 122 so as to be exposed directly to water that is carried in the main heating compartment 122 during towel heating. One way in which the towels can be positioned in the lower portion 222 of the main heating compartment 122 for "wet" heating is to position the towels side-by-side within an optional "wringer" device 250 (shown in FIGS. 3–5) that then is inserted into the lower portion 222 of the main heating compartment 122.

Figure 4:
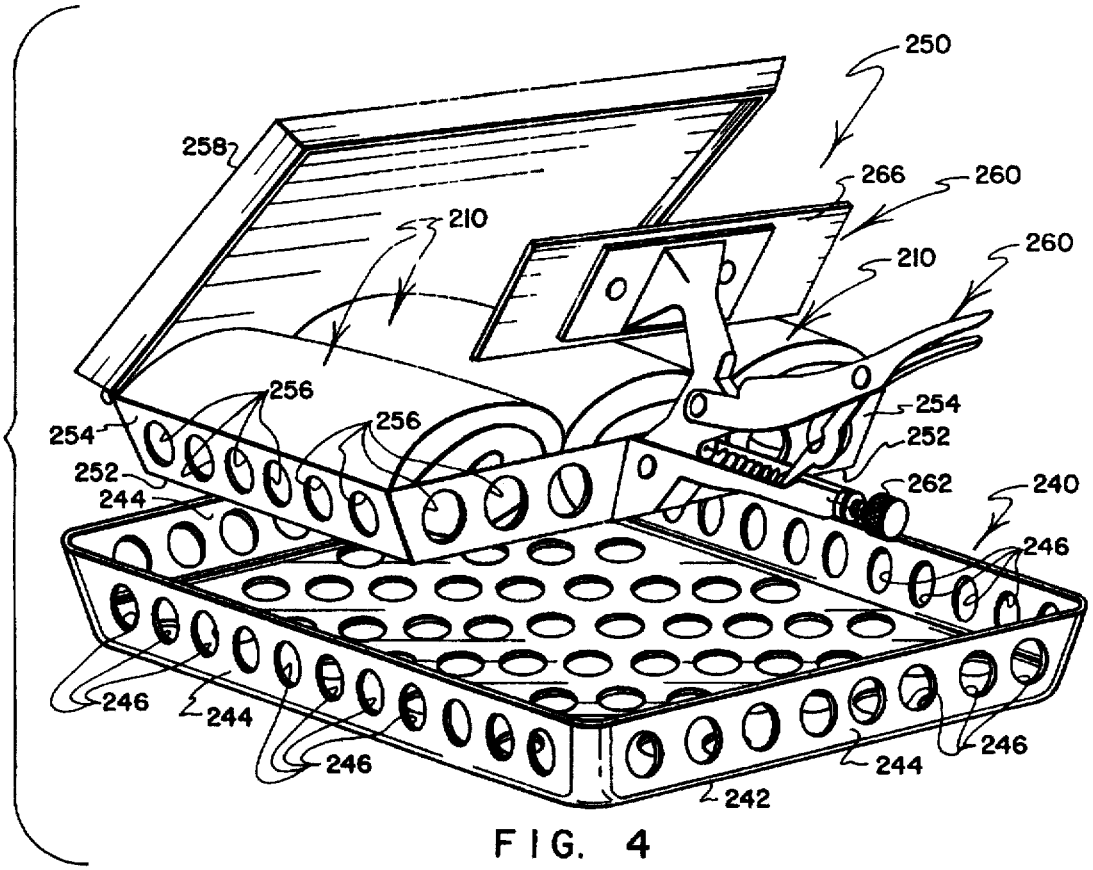
FIG. 4 is a perspective view of the wringer device of FIG. 3 but on an enlarged scale.

Referring to FIG. 4, a pan-like support device 240 is shown that preferably is used both in "dry" and "wet" heating of towels—it being understood that the terms "dry" and "wet" heating have to do with the presence or absence of moisture in towels during the time while the towels are being heated. The pan-like device 240 has a bottom wall 242 and an upstanding side wall 244 that joins with and perimetrically surrounds the bottom wall 242. Holes 246 are formed through the bottom and side walls 242, 244. The pan-like device is sized to let is easily slip fit into the lower portion 222 of the main heating compartment 122, and its size is sufficient to permit the wringer device 250 to be easily lowered into a nested position therein, and to be easily raised outwardly therefrom.

Figure 5:
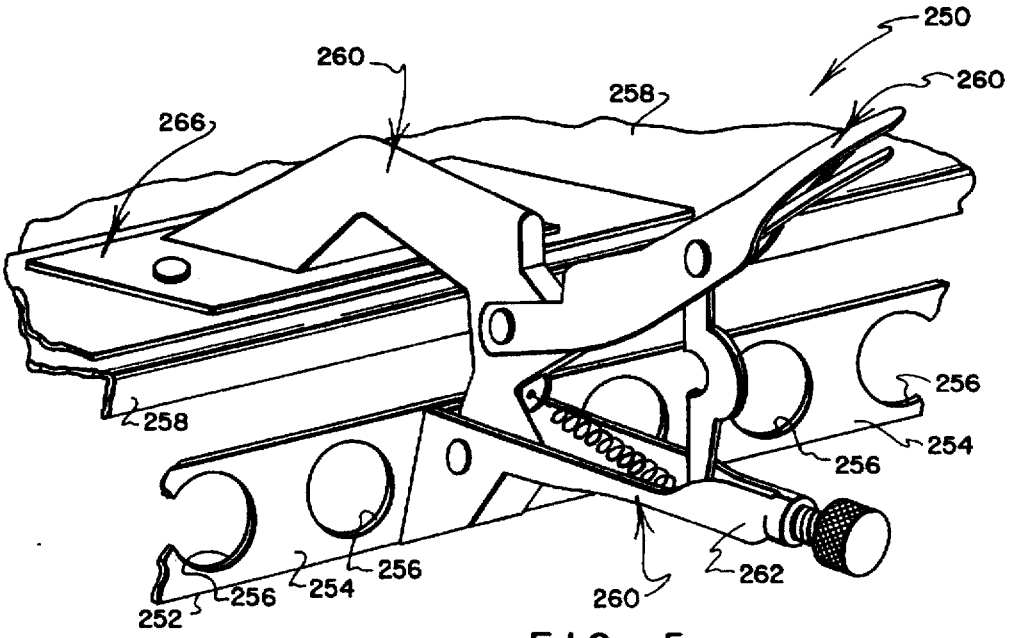
FIG. 5 is a perspective view of lid clamping portions of the wringer device, with portions of the lid and tray of the wringer also being shown, and with the view being on an enlarged scale.

A function that the pan-like device 240 serves during "wet" heating of towels is to provide something of a "liner" in the bottom or lower portion 222 of the main heating compartment 122 to help prevent the walls of the main heating compartment 122 from being scratched or scuffed as the wringer device 250 is repeatedly inserted into and removed from the main heating compartment 122 to sequentially heat (and occasionally to reheat) small numbers of towels 210. To carry out this function, the pan-like device 240 is positioned in the bottom portion 222 of the main heating compartment 122 (as is depicted in FIG. 5) in a "right-side-up" orientation (i.e., with the bottom wall 242 extending along the bottom wall of the main heating compartment 122).

A function that the pan-like device 240 serves during "dry" heating of towels is to provide a pervious support for positioning relatively tightly rolled towels 200 within the upper portion 224 of the main heating compartment 122. To carry out this function, the pan-like device 240 is inverted (i.e., turned "upside down") relative to the "right-side-up" orientation that is depicted in FIG. 4. By this arrangement, when the pan-like device 240 is inserted into the bottom portion 222 of the main heating chamber 122, the bottom wall 242 is spaced upwardly from the bottom wall of the compartment 122 to support the towels 200 at a height that will facilitate an upward flow of moist air and steam from such water as is being heated in the bottom of the compartment 122. The rising moist heated air and steam tends to penetrate and warm the towels 200 so that, within a reasonably short period of time, the towels 200 are properly heated and are continuing to be heated to a proper temperature for use in concert with the administration of a massage.

A feature of "dry" heating is that, once the appliance 100 is "set up" and loaded with rolled towels 200 that are being heated in the manner just described, a relatively large number of towels 200 is made available that will permit withdrawal from the appliance 100 and return to the appliance 100 of a significant "recycle rate" of "dry" heated towels that will facilitate the administration of a massage. While the capacity of the appliance 100 to provide "dry" heated towels in a steady and substantially uninterrupted, relatively high "recycle rate" is unusual, this "heavy duty" capacity is appropriate, for it is precisely the circumstance of administering a massage wherein "dry" heated towels are being used that such a capacity often is most dearly needed. Thus, in meeting the often "high capacity" need for supplying "dry" heated towels, the apparatus 100 scores highly.

Because circumstances are encountered from time to time wherein the "deep-heat" penetration capability of "wet" heated towels is needed, the apparatus 100 also is designed to respond quite nicely to the nature of this need. "Wet" heated towels typically take a bit longer to heat than do "dry" heated towels—but, when properly heated, tend to retain heat for a longer period of time, whereby the towels tend to be left in place for longer periods of time, and fewer tend to be required during a given period of time than usually is the case with the use of "dry" heated towels.

To accommodate this very different character of need for the supply of "wet" heated towels, and to provide "wet"

heated towels at a relatively slow but entirely appropriate pace as they are needed in concert with the administration of a massage, towels 210 that are to be "wet" heated are rolled into relatively loose coils, and, as is depicted in FIG. 4, only a few at a time (typically about three) are introduced into the wringer device 250 for insertion into such hot water as is being substantially continuously heated at the bottom of the main heating compartment 122. Because "wet" heated towels tend to be used and returned for reheat at a much slower pace than are "dry" heated towels, the "small batch at a time" approach that is employed in accordance with the preferred practice of the present invention is found to coincide quite nicely with the actual need that typically is en- countered in conjunction with the administration of a massage wherein "wet" heated towels are being used.

Referring to FIGS. 3 and 4, the wringer device 250 has a bottom wall 252, an upstanding perimetrically-extending side wall 254, and holes 256 formed through the bottom and side walls 252, 254. A lid 258 is pivotally hinge-connected to the side wall 254. While holes (not shown) could be provided in the lid 258 to permit the passage therethrough of moist heated air and steam, it is believed that the dual objectives of providing a strong, non-deforming lid 258, and of capturing heat energy from rising flows of moist heated air and steam are better served by providing few if any holes through the lid 258. When the lid 258 is firmly clamped into engagement with the upper edge region of the perimetrically-extending side wall 254, such relatively loosely rolled towels 210 as are carried within the wringer device 250 are caused to be compressed so as to "squeeze out" excess moisture.

Referring to FIG. 3 and 4, a handle-operated clamp 260 is connected to the upstanding side wall 254. The handle-operated clamp 260 serves a number of purposes, one of which is simply to provide a graspable handle that will facilitate one's moving the wringer device 250 into and out of the pan-like member 240 when the pan-like member 240 is positioned within the bottom region 222 of the main heating chamber 122. A main lever assembly 262 is rigidly connected to the side wall 254 for purposes of providing such a graspable handle. An operating lever assembly 264 is linkage-connected to the main lever assembly 262, and connects with a clamping member 266 that is "released from claiming" when the handles assemblies 262, 264 are positioned as shown in FIGS. 3 and 4 so as to neither block nor hinder pivotal movements of the lid 258 between "open" and "closed" positions.

When the lid 258 is closed and the handle assemblies 262, 264 are moved relative to each other to the positions that are depicted in FIG. 5, the clamping member 266 is brought into firm clamping engagement with the lid 258. When the handle assemblies 262, 264 are tightly squeezed so as to move relatively toward each other, the clamping force applied to the lid 258 is caused to very significantly increase in magnitude due to the configuration of the conventional arrangement of linkage that is used to interconnect the handle assemblies 262, 264. As those who are skilled in the art readily will appreciate, the type of linkage-interconnected handle assemblies 262, 264 that are depicted in FIGS. 3–5 is of a type that has been known for many years as the so-called "vise grip linked handle clamping assembly," which assembly has been incorporated successfully (with only minor changes in component design) into more than a hundred different types of manually operated clamping tools. While the specific clamping mechanism that is depicted in FIGS. 3–5 corresponds to that used in a line of "sheet metal clamps" produced by Vise-Grip, Inc., it will be understood by those who are skilled in the art that substantially any good quality commercially available clamping assembly can be substituted for the type that is indicated generally in the drawings by the numeral 260—the principal purpose of which is to clamp the lid 258 shut when the time is at hand to drain excess moisture from towels 210 that are carried by the wringer device 250.

Referring once again to FIGS. 1 and 2, when it is desired to position the appliance 100 on a counter top or other stable horizontal support that provides adequate surface area, the hinged connection (which is provided by base-carried and lid-carried hinge set components 140 that are shown in FIG. 3) that releasably couples the lid 130 and the base 120 does not need to be released, for both the lid 130 and the base 120 can be supported in side-by-side relationship atop a countertop or other suitable support surface (not shown) that is of adequate size.

However, if it is desired to use the appliance 100 at a convenient height in a leg-supported mode beside a bed or elsewhere in one's home where a massage is to be administered, a suitable elongate base support structure that typically takes the form of a set of commercially available telescopically-length-adjustable legs 270 preferably is provided. A set of simple telescopically extensible/retractable legs that are of a type that can make a threaded connection (or other suitable form of connection, not shown) with the base 120 is designated generally by the numeral 270 in FIG. 1.

While conventional, commercially available telescopic legs 270 are shown in FIG. 1, it will be understood that neither the structure of the legs 270 nor the details of a conventional means of connection that may be selected for use in connecting the legs 270 or other support structure to the base 120 constitute features of the present invention. Naturally, however, the legs 270 should have good strength, be reliably adjustable so as to hold the length measurements to which they are set, and should be easy to extend, retract and lock in extended and retracted positions; and, the connections used therewith to releasably couple the legs 270 to the base should be selected to be reliable, sturdy and easy to use. Telescopic legs 270 that make threaded connections with the base 120 are preferred.

Referring to FIG. 2, a door-accessible elongate compartment 272 is defined by the lid 130 to receive the legs 270 or other suitable support structure during storage and transport of the appliance 100. A suitable door 274 is provided that preferably has a suitable latch (not shown) for releasably holding the door-accessible compartment 272 closed when a set of legs 270 or other suitable support structure is housed therein.

To ready the appliance 100 for storage or transport, the legs 270 or other form of base-connected support should be removed and stored in the compartment 272. The power cord 160 should be disconnected from any wall outlet or other electrical connector into which its plug 162 has been inserted, and should be inserted into the power cord storage compartment 124. The containers 156, 158 should be nested within the compartments 126, 128, as is shown in FIG. 2 (and, if any tightening of closures or disabling of the dispensing devices 157, 159 is needed to prevent leakage of liquid from the containers 156, 158, this should be attended to). If the base 120 and the lid 130 do not already have their hinge components 140 pivotally connected, the sets of hinge components 140 (see FIG. 3) should be slided back into hinge-connected pivotal relationship.

Spare dry towels 200 should be packed behind straps 275 that are carried by the lid 130, with it being permissible also to insert still other spare dry towels 200 into the main heating compartment 142 (once the pan-like device 140 and the wringer device 250 and any other components or supplies that are needed to enable the closed appliance 100 to provide a "kit" that enables a massage to be administered have been secured either within available space provided by the lid 130, or within the main heating compartment 122).

A feature of that arises from connecting the power cord 160 to the base 120 at a location inside the power cord storage chamber 124 is that the power cord 160 must be put away and not permitted to dangle outside the housing 110 of the appliance 100 if the housing 110 of the appliance is to be fully closed and latched shut, in the manner of a normal suitcase, as is preferred. By this arrangement, the power cord 160 cannot accidentally be left with its plug 162 inserted into a wall receptacle or the like so as to be feeding power to the electrical components of the base 120 at a time when the appliance 100 is believed to be closed down, turned off and otherwise readied for storage or transport.

With respect to the operation of the heating element 198 that is depicted in FIGS. 7 and 8 and described previously herein as being an electrically insulated resistance heater that is of generally U-shaped configuration, those who are skilled in the art readily will understand that a host of alternative forms of electrically powered heating units that are attached to containers are well known and may be substituted for the heating element 198 that is shown and described herein. Moreover, while no thermostat or other form of temperature control has been shown in FIG. 6 for use with the heating element 198, those who are skilled in the art will understand that a temperature control of any of a wide variety of commercially available types may be used with the heating element 198; that the thermostat or other form of temperature control that is selected for Use may be a device that is pre-set, or may take the form of a consumer-adjustable control; and that such a thermostat or temperature control could be connected to and carried by either the base 120 or the container 158'. If the control is adjustable, it should be located where it is easily seen and easily accessed by a consumer, should not be of a character that will short out or cause other problems if it gets damp or is exposed to liquid, and should not be capable of operating an associated heater (such as the heating element 198) at temperatures that exceed a safe, necessary range of temperatures.

With respect to the operation of the heating elements 192, 196 that are depicted in FIGS. 7 and 8 and described previously herein as consisting of one or more electrical resistance type heaters, those who are skilled in the art will understand that it is not always possible to provide pre-set thermostat switches 190, 194 that will prove to operate the heaters 192, 196 in such a way that the heating functions they perform are always carried out at temperatures that are desired by a particular consumer. To provide the consumer with better control over the heating action of the heaters 192, 196 (or of such other forms of heaters as may be substituted for one or more of the heaters 192, 196), temperature control switches of any of a wide variety of commercially available types may comprise or be included as component parts of the temperature controls 190, 194 for operating one or both of the heaters 192, 196 at substantially the same or at appropriately different temperatures; that the thermostat(s) or other form of temperature control(s) that is/are selected for use with one or both of the heaters 192, 196 may be preset or may take the form of consumer-adjustable control(s); and that, if such thermostat(s) or temperature control(s) feature a consumer adjustable character, it/they should be located on the base 120 at easily seen and easily accessed location(s), should not be be of a character that will short out or cause other problems if exposed to dampness or to liquid, and should not be capable of operating any associated heater(s) (such as the heating elements 192, 196) at temperatures that exceed a safe, necessary range of temperatures.

An advantage that results if the thermostat or temperature control 194 takes the form of a readily accessible, consumer adjustable control is that optimum heating temperatures for both "dry" and "wet" heating of towels in the main heating compartment 122 can be provided. Furthermore, each of the thermostat or temperature control units 190, 194 (and such other thermostat or temperature control as may be used with a container-carried heater element such as the element 198) may each include an "off/on" switch and/or a timer-controlled switch that limits the period of time for which the associated heating element(s) 192, 196, 198 may be operated without being re-started. An advantage of providing timer-limited operation of the heater element(s) 192, 196, 198 is that these devices cannot then be left energized for excessive periods of time.

As will be apparent from the foregoing, the Parent Invention provides a nicely compact, highly versatile means of transporting from place to place and storing a "kit" of apparatus and supplies that are used nicely in concert to permit a massage to be administered substantially anywhere within one's home that it is desired to use the unit. Both "wet" and "dry" heating of towels is provided for, as is the heating of body oil and/or other liquid that one may want to utilize during the administration of a massage. Improvements and enhancements that are the subject of the present invention now will be described with reference to such improved appliance features as are illustrated in FIGS. 9–15.

Whereas 3-digit reference numerals are utilized in FIGS. 1–8 to designate features of the appliance 100, 4-digit reference numerals are used in FIGS. 9–15 to designate features of an improved appliance embodiment that is indicated generally by the numeral 1100. Because the appliance embodiments 100, 1100 have many corresponding, substantially identical features, it is not necessary, in describing and in depicting the appliance 1100 to repeat major portions of the foregoing description; nor is it necessary to illustrate in the drawings such features of the appliance 1100 as do not differ significantly from the features of the appliance 100 that are depicted in detail in the drawings.

To the extent that the appliance 1100 has features that "correspond" to features of the appliance 100, "corresponding" reference numerals are used to depict these "corresponding" features in the drawings—with the "corresponding" reference numerals used in FIGS. 9–15 being identical to the reference numerals used in FIGS. 1–8 except for the addition thereto of the number one thousand. Thus, for example, the base 120 of the appliance 100 corresponds to the base 1120 of the appliance 1100; the main heating compartment 122 of the appliance 100 corresponds to the main heating compartment 1122 of the appliance 1100; etc. The text presented above in conjunction with the 3-digit reference numerals that appear in FIGS. 1–8 is applicable to "corresponding" 4-digit reference numerals that appear in FIGS. 9–15.

To the extent that the appliance 1100 has features that do not correspond quite so closely to those of the appliance 100, these "non-corresponding" features are indicated in FIGS. 9–14 by reference numerals that have a magnitude greater than two thousand.

Referring to FIGS. 9–13, the appliance 1100 has a main heating chamber 1122 that is of uneven depth. Substantially half of the chamber 1122, namely the "rear" half of the chamber 1122, designated by the numeral 2123 (see FIGS. 9 and 12), is of a relatively shallow depth having a bottom wall 2252 that is inclined slightly so as to drain forwardly toward the "front" half of the chamber 1122, designated by the numeral 2125. The front half 2125 of the chamber 1122 has a "left" portion 2127 that is more shallow than is a relatively deep "well" 2129 that is located in a "right" portion of the front half 2125 of the chamber 1122. A bottom wall portion 2257 forms the floor of the left portion 2127 of the chamber 1122, and is gently inclined so as to drain rightwardly toward the well 2129. A bottom wall portion 2259 forms the floor of the well.

Figure 12:
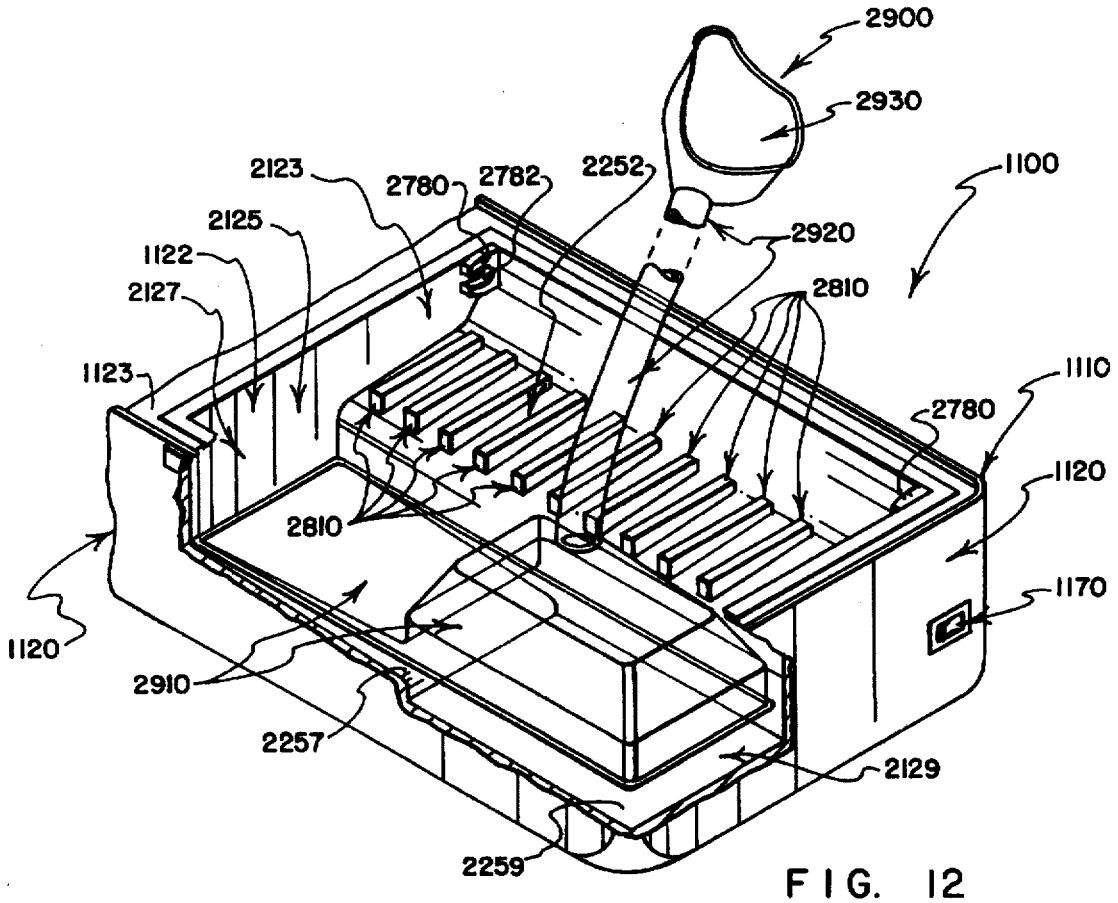
FIG. 12 is a perspective view similar to FIG. 9 but with additional portions of the appliance broken away, with the towel compressor plate removed, and with a breathing mask accessory attached to the appliance.
Figure 13:
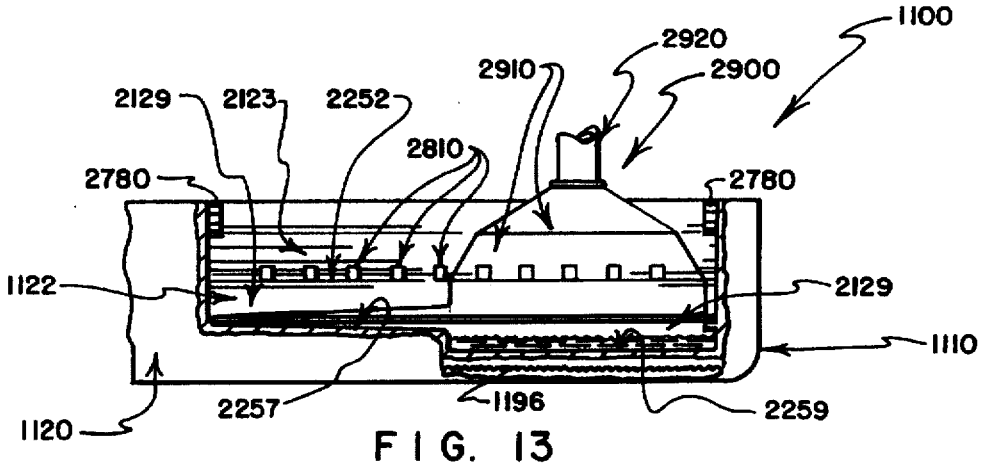
FIG. 13 is a front elevational view of a selected portion of FIG. 12.

While the appliance 100 has a main chamber heating element 196 that underlies much of the bottom wall of the main heating chamber 122, the main chamber 1122 of the appliance 1100 preferably has its heating element underlying only the front half 2125 of the chamber 1122—it being understood that, in most instances of operation of the appliance 1100, the water level in the main chamber 1122 will not be so high as to cause water to flow into the rear half 2123 of the main chamber 1122. However, if the appliance 1100 is to be used with the breathing mask accessory 2900 that is depicted in FIGS. 12 and 13, preferred practice further restricts the location of the main chamber heating element to an area extending beneath the bottom wall 2259 of the well 2129, as is indicated by the numeral 1196 in FIG. 13. As those who are skilled in the art will readily understand, it does not deviate from the spirit and scope of the present invention to add to the appliance 1100, if desired, one or more additional heating elements (not shown) and/or suitable thermostatic heating element controls (not shown) to selectively heat and/or to selectively control the heating of any of the main chamber regions 2123, 2125, 2127 and 2129.

By utilizing a heating element 1196 for the main chamber 1122 that tends to limit its direct heating action to water that is contained within the well 2129, it is has been found that three desired modes of operation of the appliance 1100 can be achieved. One possible mode of operation calls for a relatively small quantity of water that is contained mostly within the well 2129 (see FIG. 13) to be sufficiently heated to produce steam that rises, mixes with warm air, and is supplied to the breathing mask accessory 2900 that is depicted in FIGS. 12 and 13.

Second and third possible modes of operation call for a relatively larger quantity of water that is contained mostly within the front half 2125 of the main chamber 1122 (see FIG. 11) to be sufficiently heated to "dry" or "wet" heat towels that are positioned in the main chamber 1122. "Wet" heating of towels in the main chamber 1122 preferably is carried out by positioning one or more rolled towels to extend left-to-right in the front chamber half 2125, with significant portions of the towels actually submerged in the water that is contained in the front chamber half 2125. "Dry" heating of towels in the main chamber 1122 preferably is carried out by positioning a number of rolled towels to extend front-to-rear in the chamber 1122 (so as to substantially fill the top half of the chamber 1122 in the manner of the rolled towels 1200 depicted in FIG. 11), with the towels 1200 being held in place both by being positioned atop the bottom wall portion 2252 (that underlies the rear chamber half 2123), and by the presence of a wringer compressor plate 2750 (which will be described shortly) that overlies and rests upon rear portions of the towels 1200.

Figure 9:
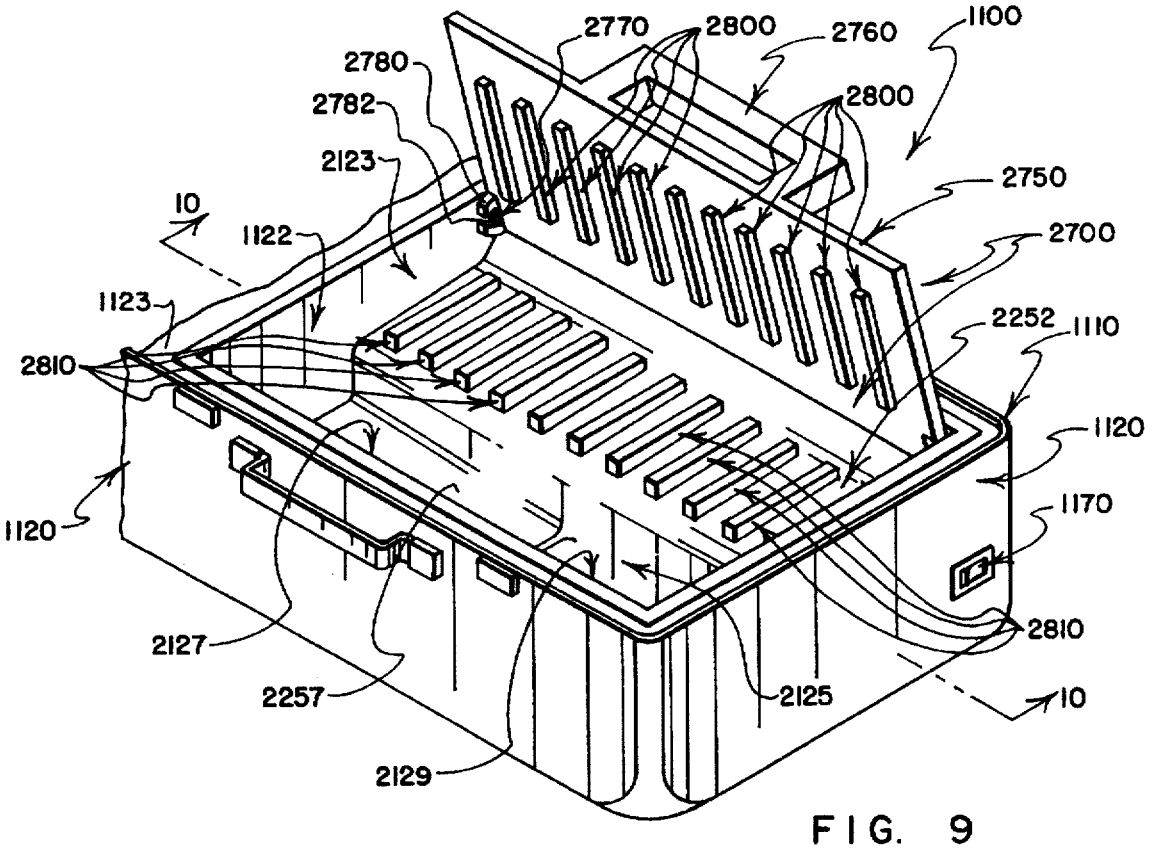
FIG. 9 is a perspective view similar to FIG. 2, but showing an alternate embodiment of the appliance that embodies features of the present invention, with only such portions of the appliance being shown as differ from the appliance embodiment depicted in FIGS. 1–8, and with a towel compressor plate pivoted to a "towel insert and removal" position.
Figure 10:
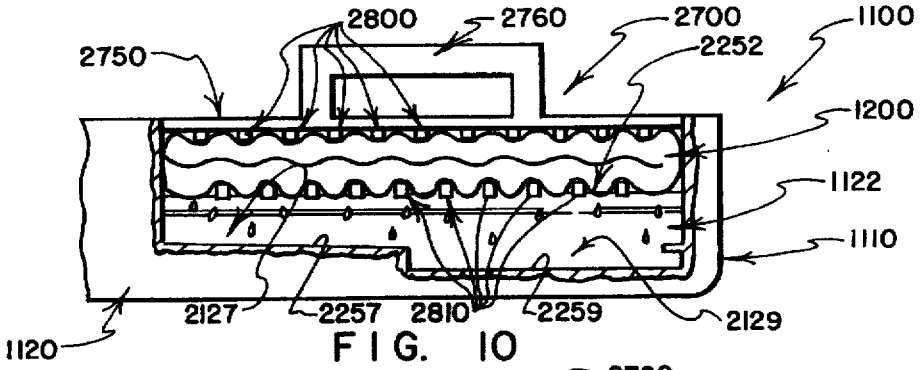
FIG. 10 is front elevational view of FIG. 9, but with portions thereof broken away and shown in cross-section as seen from a plane indicated by a line 10—10 in FIG. 9, and with the towel compressor plate pivoted to a "towel compression" position, and shown squeezing a towel.
Figure 11:
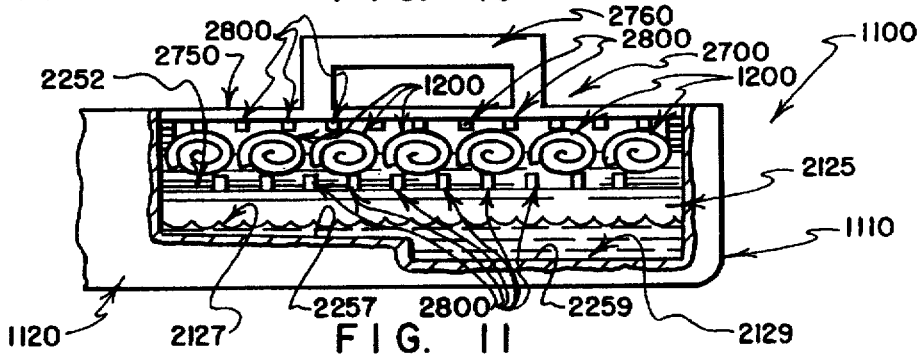
FIG. 11 is a front elevational view with portions broken away and shown in cross section similar to FIG. 10 but showing a relatively larger quantity of water that is contained mostly in the front half of the main chamber for the "wet" heating of towels that are positioned to extend front-to-rear in the top half of the chamber for "dry" heating.

Referring to FIGS. 9–11, for the purpose of wringing excess moisture from "wet" heated towels, the appliance 1100 includes an improved form of towel wringer, indicated generally by the numeral 2700. The wringer 2700 basically includes two components, both of which have already been mentioned, namely the bottom wall portion 2252 that underlies the rear half 2123 of the chamber 1122, and the compressor plate 2750.

The compressor plate 2750 is a generally rectangular, substantially rigid member that preferably is formed from molded plastic material. An operating handle 2760 is provided that projects upwardly from a front part of the plate 2750. To pivotally connect the plate 2750 to the base member 1120, a pair of opposed, generally cylindrical (identically configured) projections 2770 extend from opposite sides of a rear part of the plate 2750, one of which is shown in FIG. 9. To receive the projections 2770, the base 1120 is provided with an opposed pair of (identically configured) formations 2780 that extend into rear portions of the chamber 1122 along opposite sides thereof. The formations 2780 define a pair of (identically configured) forwardly-facing U-shaped recesses 2782 (one of which is best seen in FIG. 12) into which the projections 2770 can be inserted, and within which the projections 2770 can turn as the compressor plate 2750 is pivoted relative to the base 1120 about the axis of the aligned, opposed projections 2770 between a "towel insert and removal" position depicted in FIG. 9, and a "towel compress" ion position depicted in FIG. 10. The U-shaped recesses 2782 permit the cylindrical projections 2770 to be inserted and removed therefrom so that, when desired, the compressor plate 2750 can be detached from the base member 1120.

Depending from the underside of the compressor plate 2750, and extending upwardly from the bottom wall portion 2252 are spaced arrays of rib-like projections 2800, 2810, respectively. The projections 2800 are spaced apart by substantially equal distances, and extend in a front-to-rear orientation for engaging top surface portions of a moisture-laden towel 1200 from which excess moisture is to be wrung, as depicted in FIG. 10. The projections 2810 are spaced apart by substantially the same equal distances, extend in a front-to-rear orientation, project upwardly toward spaces that separate the projections 2800, and serve to engage bottom surface portions of a towel 1200 that is being compressed by the compressor plate 2750. As is depicted in FIG. 10, the interaction of alternate engagements with a compressed towel 1200 by the projections 2800, 2810 tends to bend, stretch and compress various portions of the fabric of the towel 1200 to facilitate the extraction of excess moisture therefrom when external, downwardly directed force is applied to the handle 2760 to pivot the compressor plate 2750 toward the bottom wall portion 2252 to compress a towel 1200 therebetween.

Referring to FIGS. 12 and 13, the breathing mask accessory 2900 includes three components that preferably are formed from heat resistant, substantially transparent plastic material, namely: a collection hood 2910 that is configured to be loosely received within the front chamber half 2125; a flexible, elongate tubular member 2920 that communicates at its lower end with the interior of the collection hood 2910; and a face mask 2930 that communicates with the upper end of the tubular member 2920. These three components cooperate to collect steam mixed with warm air from atop the front half 2125 of the main heating chamber 1122, and to duct the mixture of steam and warm air to the face mask 2930 for being inhaled by a person who positions his nose and mouth (not shown) to inhale the steam and warm air mixture from within the interior of the thin-walled face mask 2930. The inhaled mixture of steam and warm air is found by some persons to aid in relieving congestion of nasal and bronchial passages due to colds and flu virus.

When the breathing mask accessory 2900 is to be used with the appliance 1100, preferred practice calls for only a relatively small quantity of water be heated in the main chamber well 2129—so that the heat energy imparted to this relatively small quantity of water will be sufficiently intense to cause the generation of a relatively generous amount of steam to mix with warm air that is collected by the hood 2910 for ducting through the flexible tubular member 2920 to the face mask 2930.

In preferred practice, the materials from which the components of the breathing mask accessory 2900 are formed, and the configurations and flexibilities of the materials used to form its component parts 2910, 2920, 2930 are selected to permit the components 2910, 2920, 2930 to be easily assembled in a slide-together manner for use, and to be easily disassembled, by being slided apart, for cleaning and for being received within the main chamber 1122 when the appliance 1100 is to be stored or transported.

Figure 14:
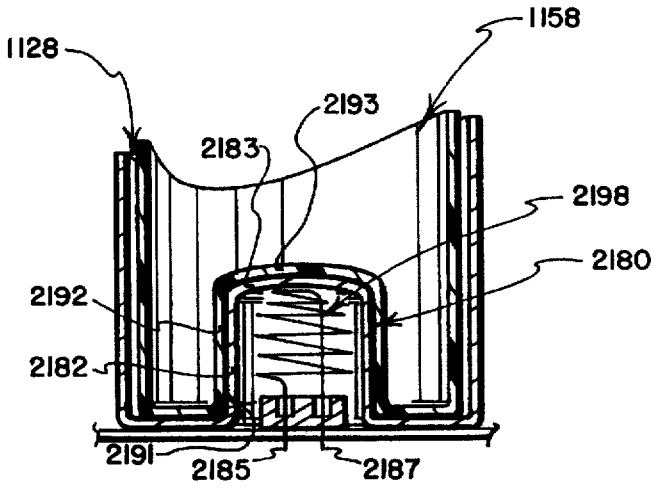
FIG. 14 is a sectional view similar to FIG. 7 but showing bottom portions of an improved form of liquid container inserted into portions of an auxiliary heating compartment of the appliance; and, FIG. 15 is an exploded perspective view of the components that are depicted in FIG. 14, with selected portions thereof broken away.
Figure 15:
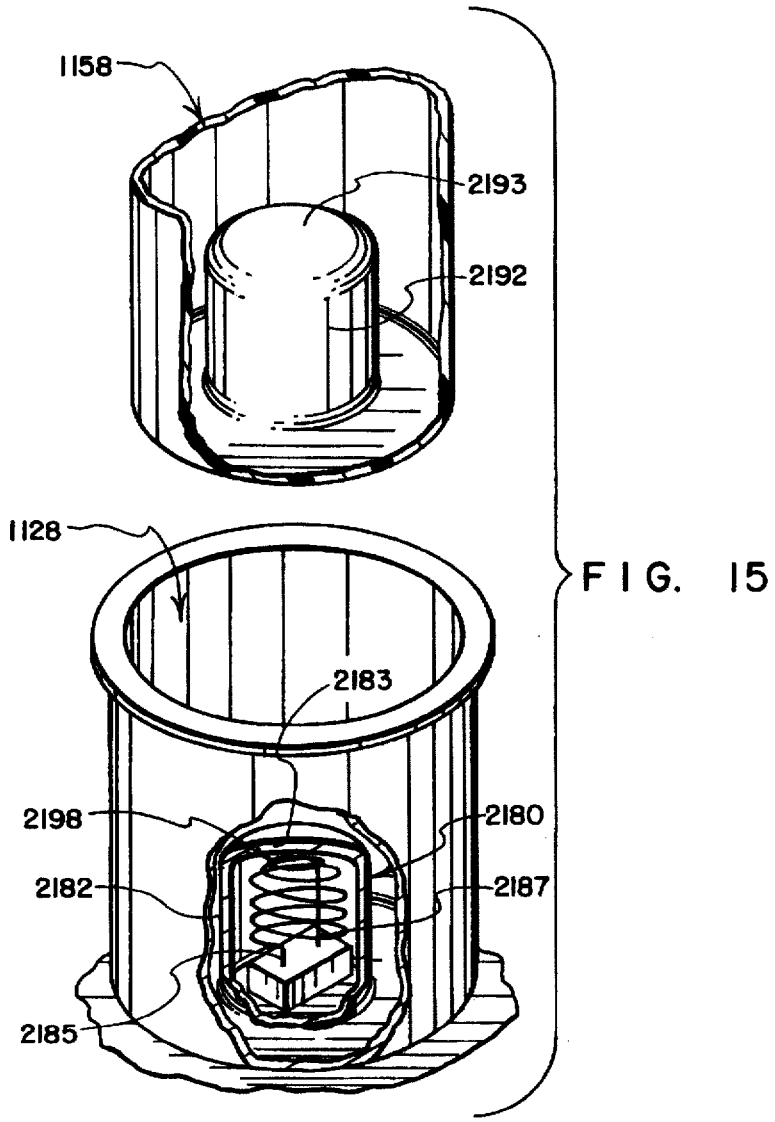

Referring to FIGS. 14 and 15, still another improvement feature of the present invention relates to an improved form of liquid container 1158, and an improved, form of heater 2180 that can be utilized to rapidly heat liquid contents of the container 1158 so that a plurality of the containers 1158 can be kept warm by cycling them, one at a time, into the auxiliary heating compartment 1128 for being heated by the heater 2180.

A feature of the container 1158 is the provision, centered on its bottom wall, of a relatively sizable recess 2191 that is defined by a generally cylindrical, upstanding container wall portion 2192, and by a generally dome-shaped, transversely extending container wall portion 2193, both of which are formed integrally with other wall portions of the container 1158. The cylindrical and dome-shaped walls define a relatively large internal surface area that is in direct contact with such liquid as may be contained by the container 1158. The heater 2180 has cylindrical and dome-shaped walls 2182, 2183 that extend closely along exterior surfaces of the walls 2192, 2193 to conductively transfer heat energy from an electrical heating element 2187 of the heater 2180 for heating liquid contained within the container 1158. The relatively large area of surface contact that is provided between the closely interfitting cylindrical walls 2182, 2192 and the relatively closely interfitting dome-shaped walls 2183, 2193 provides for efficient conductive heat transfer, and will permit a substantial amount of heat energy to be transferred quickly from the heating element 2187 to the liquid contents of the container 1158 if a plurality of containers 1158 of liquid are to be heated rapidly in turn.

While such terms as "horizontally extending," "left," "right," "front," "rear" and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A portable heating appliance having a housing that, when "closed," can be stored and transported with substantially the ease and convenience of a suitcase, and when "open" provides access to a plurality of compartments including plural heating compartments for heating substantially concurrently but in separate heating compartments a quantity of towels and a quantity of liquid such as body oil for use in concert with the administration of a massage, comprising:

a) housing means having at least two housing members including a base member and a lid member that are connected for movement relative to each other between "closed" and "open" positions, with the housing means functioning:

i) to define an array of compartments for cooperating when the housing members are "closed" 1) to receive and protectively enclose such components of the appliance as may be removed from the housing means during use of the appliance in concert with the administration of a massage, and 2) to house such supplies as are utilized in conjunction with use of appliance including a quantity of towels for being heated by the appliance, and at least one container enclosing a quantity of liquid such as body oil for being heated by the appliance; and, ii) to define, when "open," exterior structure that can be supported atop a horizontal surface for supporting at least the base member to extend substantially horizontally, and interior structure that defines within the interior of the housing means compartments that include 1) main heating compartment means for receiving and heating a plurality of towels, and 2) auxiliary heating compartment means for receiving at least one container enclosing a quantity of liquid such as body oil and for heating the quantity of liquid contained therein;

b) electrical heating means for being operated when the housing means is "open" to substantially concurrently heat 1) at least a plurality of towels that are contained within the main heating compartment means, and 2) a quantity of liquid that is contained within a container that is nested within the auxiliary heating compartment means, whereby liquid is heated so that it can be dispensed from the container substantially simultaneously with the provision of a supply of heated towels that can be withdrawn from the main heating compartment means for use in concert with the administration of a massage; and, c) wringer means connected to the housing means for being transported within the housing means when the housing means is "closed," and for being operated substantially adjacent the main heating compartment means when the housing means is "open" to compress at least one moisture-laden towel that has been "wet" heated within the main heating compartment means to extract moisture therefrom, and for draining into the main heating compartment means moisture extracted from a towel that is compressed during operation of the wringer means.

2. The portable heating appliance of claim 1 wherein the relatively movable housing members of the housing means include a base member and a lid member, and the appliance includes hinge means for selectively permitting the lid member and the base member to pivot relative to each other between "closed" and "open" positions.

3. The portable heating appliance of claim 2 wherein the main heating compartment means and the auxiliary heating compartment means are defined by the base member, and wherein the electrical heating means is connected to and protectively housed within the base member.

4. The portable heating appliance of claim 3 wherein the electrical heating means includes separate main and auxiliary electrical heaters that are associated with the main and auxiliary heating compartments, respectively.

5. The portable heating appliance of claim 4 additionally including electrical temperature control means for being electrically connected to at least a selected one of the separate main and auxiliary electrical heaters for controlling the electrical heating action that is provided thereby.

6. The portable heating appliance of claim 1 wherein the main heating compartment means includes a relatively large main heating compartment that is defined by the base member; the auxiliary heating compartment means includes at least one relatively smaller auxiliary heating compartment that is defined by the base member; the main heating compartment means and the auxiliary heating compartment means both open upwardly when the base member extends substantially horizontally; and the main heating compartment defines a relatively shallow region atop which the wringer means is operable to compress a moisture-laden towel to extract excess moisture therefrom, and a region of greater depth into which the relatively shallow region drains for ducting into the region of greater depth moisture that has been wrung from a tower during operation of the wringer means.

7. The portable heating appliance of claim 6 wherein the main heating compartment is defined, in part, by a bottom wall portion that underlies the relatively shallow region of the main heating compartment; and, the wringer means includes compressor plate means 1) for being pivotally connected to the housing means so as to overlie and to be movable relatively toward and away from said bottom wall portion, and 2) for being pivotally movable under application of external force toward said bottom wall portion for compressing between the compressor plate means and said bottom wall portion it least one moisture-laden towel to extract moisture therefrom.

8. The portable heating appliance of claim 7 additionally including towel engagement formation means carried by the compressor plate means and by said bottom wall portion for cooperatively engaging and squeezing moisture from a towel that is positioned between the compressor plate means and said bottom wall portion during said application of external force.

9. The portable heating appliance of claim 8 wherein the towel engagement formation means includes a first spaced array of rib-shaped projections depending from the compressor plate means toward said bottom wall portion, and a second spaced array of rib-shaped projections extending from said bottom wall portion toward spaces located between the rib-shaped projections of the first spaced array.

10. The portable heating appliance of claim 7 additionally including connection means for releasably connecting the compressor plate means to the housing means so that, when the wringer means is not being utilized for the purpose of compressively extracting moisture from towels, the compressor plate means can be disconnected from the housing means.

11. The portable heating appliance of claim 1 wherein the main heating compartment means includes a relatively large main heating compartment of non-uniform depth that is defined by the base member; the auxiliary heating compartment means includes at least one relatively smaller auxiliary heating compartment that is defined by the base member; the main heating compartment means and the auxiliary heating compartment means both open upwardly when the base member extends substantially horizontally; the main heating compartment is not of uniform depth in that, when the base extends substantially horizontally, the main heating compartment defines a relatively deep well into which other, more shallow regions of the main heating compartment drain; the electrical heating means is operable to heat water contained within the well so as to cause steam rising therefrom to mix with warm air located above the well; and mask means is provided for ducting moist, warm air from above the well to a position where one's nose and mouth can be brought into engagement with the mask means to permit the moist, warm air to be inhaled.

12. The portable heating appliance of claim 11 wherein the mask means includes a face engagement mask configured to extend about one's mouth and nose, passage defining means connected to and communicating with the face engagement mask for ducting moisture-laden air through the passage defining means and into the face engagement mask, and hood means configured to be releasably connected to the housing means for overlying said well of the main heating compartment for ducting moisture-laden air from atop said well into said passage defining means.

13. The portable heating appliance of claim 1 wherein the appliance additionally includes container means for enclosing a quantity of liquid such as body oil, with the container means including a liquid container having a bottom wall with a pronounced recess formed therein, and wherein the electrical heating means includes heating element means configured to project into the pronounced recess of the liquid container when the liquid container is inserted into the auxiliary heating compartment means for engaging the liquid container to conductively transfer heat energy from the heating element means to the liquid container for heating a quantity of liquid contained within the liquid container.

14. The portable appliance of claim 13 wherein said container includes a manually operated dispenser for dispensing heated fluid contents therefrom.

15. A portable heating appliance for warming towels and liquid such as body oil for use in concert with the administration of a massage, comprising:

a) housing means formed from a plurality of relatively movable housing components 1) for being oriented in a "closed" position wherein the housing components are connected and cooperate to define and extend peripherally about a plurality of interior compartments to protectively enshroud the interior compartments and any contents contained therein so as to provide a kit-like unit that can be transported and stored with substantially the same ease as a suitcase when the housing components are "closed," and 2) for being relatively movable between the "closed" position and an "open" position wherein the housing components cooperate to permit access to the interior compartments;

b) support means for supporting, when the housing components are "open," a selected one of the housing components atop a surface that underlies the selected housing component to facilitate the use of the appliance in concert with the administration of a massage;

c) chamber defining means connected to the selected housing component for defining a relatively large main heating chamber as one of said plurality of interior compartments, which main heating chamber can be utilized when the housing components are "open" to receive a plurality of towels that are to be heated within the main chamber for use in concert with the administration of a massage, for defining at least one auxiliary chamber as another of said plurality of interior compartments, which auxiliary chamber can be utilized when the housing components are "open" to receive at least one container of liquid such as body oil that is to be heated within said auxiliary chamber for use in concert with the administration of a massage, and for permitting the housing components to be "closed" at a time 1) when a plurality of towels are received within the main chamber, and 2) when at least one container of liquid is received within said at least one auxiliary chamber, whereby the configuring of the appliance for storage within a minimum of space is facilitated, and the overall size of the appliance is minimized for transport;

d) electrical heating means connected to and carried within the selected housing component for heating towels that are positioned within the main chamber to a first predetermined temperature that renders the towels suitable for use in concert with the administration of a massage, and for heating at least one container of liquid that is received within said at least one auxiliary chamber to a second predetermined temperature that renders the liquid suitable for use in concert with the administration of a massage; and, e) wringer means connected to the housing means for being transported within the housing means when the relatively movable housing components are "closed," and for being operated substantially adjacent the main chamber when the relatively movable housing components are "open" to compress at least one moisture-laden towel that has been "wet" heated within the main chamber to extract excess moisture therefrom, and for draining into the main chamber moisture extracted from a towel that is compressed during operation of the wringer means.

16. The portable heating appliance of claim 15 wherein the relatively movable housing members of the housing means include a base member and a lid member, and the appliance includes hinge means for selectively permitting the lid member and the base member to pivot relative to each other between "closed" and "open" positions.

17. The portable heating appliance of claim 16 wherein the main heating chamber and the auxiliary heating chamber are defined by the base member, and wherein the electrical heating means is connected to and protectively housed within the base member.

18. The portable heating appliance of claim 15 wherein the electrical heating means includes separate main and auxiliary electrical heaters that are associated with the main and auxiliary heating chambers, respectively.

19. The portable heating appliance of claim 18 additionally including electrical temperature control means for being electrically connected to at least a selected one of the separate main and auxiliary electrical heaters for controlling the electrical heating action that is provided thereby.

20. The portable heating appliance of claim 15 wherein the main heating chamber defines a relatively shallow region atop which the wringer means is operable to compress a moisture-laden towel to extract excess moisture therefrom, and a region of greater depth into which the relatively shallow region drains for ducting into the region of greater depth moisture that has been wrung from a tower during operation of the wringer means.

21. The portable heating appliance of claim 20 wherein the main heating chamber is defined, in part, by a bottom wall portion that underlies the relatively shallow region of the main heating chamber; and, the wringer means includes compressor plate means 1) for being pivotally connected to the selected housing component so as to over-lie and to be movable relatively toward and away from said bottom wall portion, and 2) for being pivotally movable under application of external force toward said bottom wall portion for compressing between the compressor plate means and said bottom wall portion at least one moisture-laden towel to extract moisture therefrom.

22. The portable heating appliance of claim 21 additionally including towel engagement formation means carried by the compressor plate means and by said bottom wall portion for cooperatively engaging and squeezing moisture from a towel that is positioned between the compressor plate means and said bottom wall portion during said application of external force.

23. The portable heating appliance of claim 22 wherein the towel engagement formation means includes a first spaced array of rib-shaped projections depending from the compressor plate means toward said bottom wall portion, and a second spaced array of rib-shaped projections extending from said bottom wall portion toward spaces located between the rib-shaped projections of the first spaced array.

24. The portable heating appliance of claim 21 additionally including connection means for releasably connecting the compressor plate means to the selected housing component so that, when the wringer means is not being utilized for the purpose of compressively extracting moisture from towels, the compressor plate means can be disconnected from the selected housing component.

25. The portable heating appliance of claim 15 wherein the main heating chamber is of non-uniform depth and defines a relatively deep well into which other, more shallow regions of the main heating chamber drain; the electrical heating means is operable to heat water contained within the well so as to cause steam rising therefrom to mix with warm air located above the well; and mask means is provided for ducting moist, warm air from above the well to a position where one's nose and mouth can be brought into engagement with the mask means to permit the moist, warm air to be inhaled.

26. The portable heating appliance of claim 25 wherein the mask means includes a face engagement mask configured to extend about one's mouth and nose, passage defining means connected to and communicating with the face engagement mask for ducting moisture-laden air through the passage defining means and into the face engagement mask, and hood means configured to be releasably connected to the selected housing component for overlying said well of the main heating chamber and for ducting moisture-laden air from atop said well into said passage defining means.

27. The portable heating appliance of claim 15 wherein the appliance additionally includes container means for enclosing a quantity of liquid such as body oil, with the container means including a liquid container having a bottom wall with a pronounced recess formed therein, and wherein the electrical heating means includes heating element means configured to project into the pronounced recess of the liquid container when the liquid container is inserted into the auxiliary heating compartment means for engaging the liquid container to conductively transfer heat energy from the heating element means to the liquid container for heating a quantity of liquid contained within the liquid container.

28. The portable appliance of claim 27 wherein said container includes a manually operated dispenser for dispensing heated fluid contents therefrom.

* * * * *